US005362037A

United States Patent [19]

van der Werff et al.

[11] Patent Number: 5,362,037

[45] Date of Patent: Nov. 8, 1994

[54] METHOD OF, AND APPARATUS FOR, DELIVERING FLAT ARTICLES ONE BY ONE FROM A STACK OF SUCH ARTICLES

[75] Inventors: Jeichienus A. van der Werff, Montfoort; Hendrik A. de Haan, Bergum, both of Netherlands

[73] Assignee: Hadewe B.V., Drachten, Netherlands

[21] Appl. No.: 917,055

[22] PCT Filed: Feb. 11, 1991

[86] PCT No.: PCT/NL91/00023

§ 371 Date: Aug. 7, 1992

§ 102(e) Date: Aug. 7, 1992

[87] PCT Pub. No.: WO91/12193

PCT Pub. Date: Aug. 22, 1991

[30] Foreign Application Priority Data

Feb. 9, 1990 [NL] Netherlands ..... 9000309

[51] Int. Cl.[5] ..... B65H 5/00

[52] U.S. Cl. ..... 271/10; 271/110; 271/116; 271/117; 271/122; 271/125

[58] Field of Search ..... 271/10, 110, 114, 115, 271/116, 117, 121, 122, 124, 125

[56] References Cited

U.S. PATENT DOCUMENTS

| | | | |
|---|---|---|---|
| 2,791,425 | 5/1957 | Ford et al. | 271/36 |
| 3,761,079 | 9/1973 | Azure, Jr. | 271/116 |
| 4,522,385 | 6/1985 | Stefansson | 217/10 |
| 4,753,432 | 6/1988 | Freeman | 271/35 |
| 4,775,140 | 10/1988 | Foster | 271/121 |
| 4,927,130 | 5/1990 | Tanaka et al. | 271/114 X |
| 4,934,686 | 6/1990 | Ono et al. | 271/116 X |
| 5,116,038 | 5/1992 | Kim | 271/116 X |
| 5,141,217 | 8/1992 | Lin et al. | 271/115 X |

FOREIGN PATENT DOCUMENTS

| | | | |
|---|---|---|---|
| 0307245 | 3/1989 | European Pat. Off. . | |
| 2051677 | 4/1972 | Germany . | |
| 2851458 | 6/1980 | Germany . | |
| 3334522 | 3/1984 | Germany . | |
| 3731494 | 3/1988 | Germany . | |
| 0980035 | 7/1980 | Japan | 271/122 |
| 0057142 | 4/1982 | Japan | 271/122 |
| 0172136 | 10/1983 | Japan | 271/122 |
| 0235143 | 10/1987 | Japan | 271/122 |
| 0041335 | 2/1988 | Japan | 271/122 |
| 0225035 | 9/1988 | Japan | 271/122 |
| 0008139 | 1/1989 | Japan | 271/122 |
| 0092137 | 4/1989 | Japan | 271/122 |
| 0117145 | 5/1989 | Japan | 271/122 |

*Primary Examiner*—H. Grant Skaggs
*Assistant Examiner*—Carol L. Druzbick
*Attorney, Agent, or Firm*—Burns, Doane, Swecker & Mathis

[57] ABSTRACT

A method for separating articles, such as paper or plastics sheets or envelopes, from a stack (9), and apparatus for carrying out this method is disclosed. A feed roller (6) periodically feeds an outer article to a conveyor roller (2) opposite to which a separation surface (3) is disposed. The pressure force of the feed roller (6) on the stack (9) is reduced when an article supplied is being carried off by the conveyor roller (2). The object of the invention is to provide such a method which can be carried out reliably with a simple construction. According to the invention, each time an article (8) is carried off by the conveyor roller (2), the feed roller (6) is carried along by said article (8) as long as the feed roller (6) bears on that article (8). The force with which the feed roller (6) bears on the stack (9) is then enhanced by the action of frictional force which is exerted by the feed roller (6) on an article (8) to be carried off.

23 Claims, 3 Drawing Sheets

FIG. 2
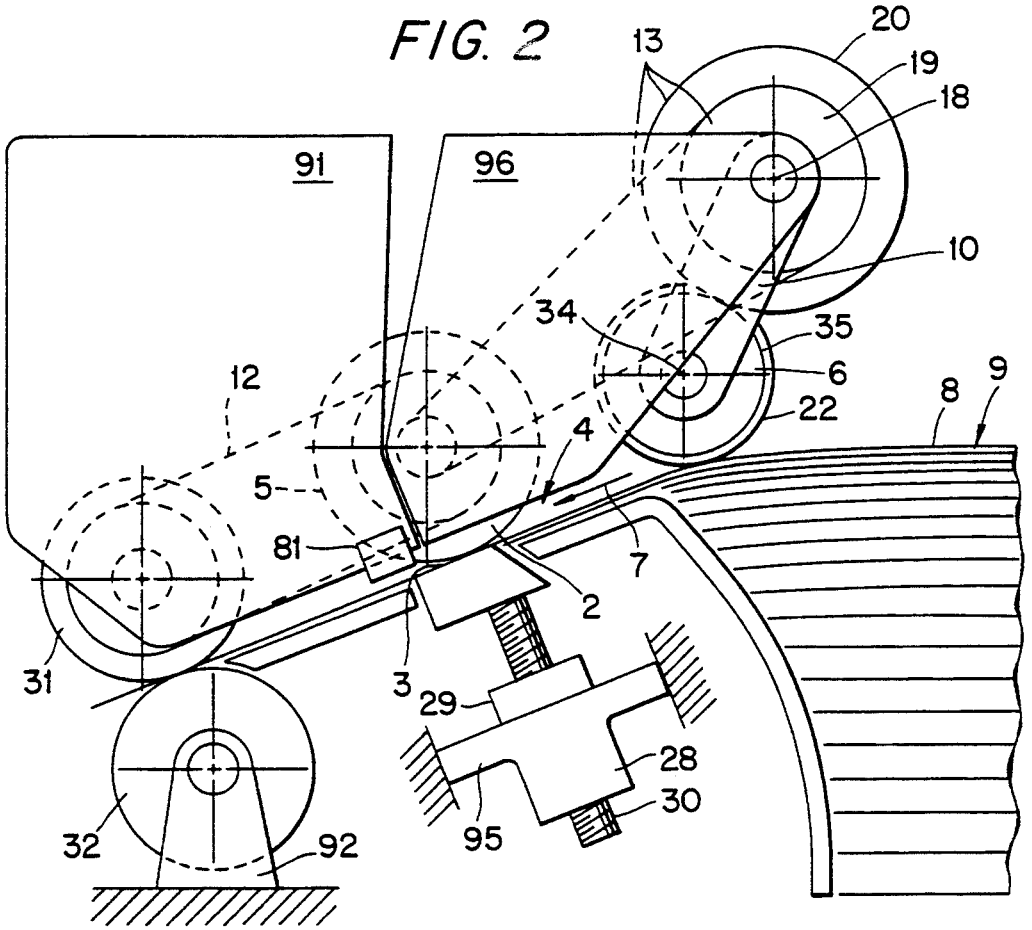
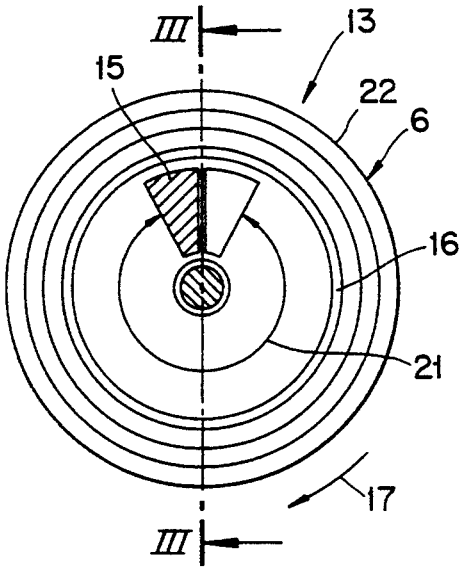
FIG. 4
FIG. 5
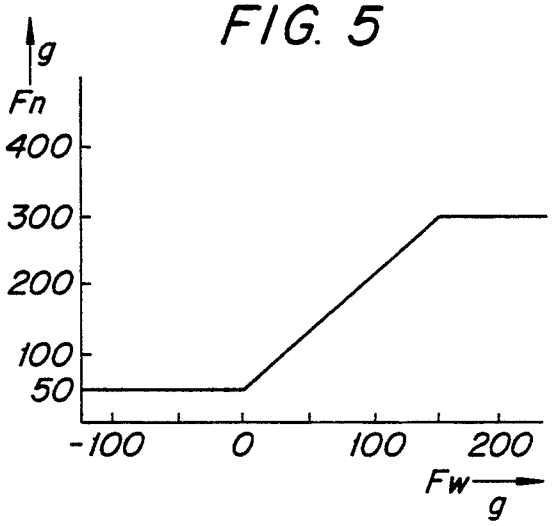

METHOD OF, AND APPARATUS FOR, DELIVERING FLAT ARTICLES ONE BY ONE FROM A STACK OF SUCH ARTICLES

The invention relates to a method of delivering, one by one, flat articles of some stiffness, such as paper or plastics sheets or envelopes, from a stack in a direction of transport, using a feed roller exerting a pressure on an outer article of the stack, a conveyor roller opposite which a separation surface is arranged, and in which the conveyor roller and the separation surface form a separation area between the outer surface of the conveyor roller and the separation surface, the conveyor roller and the feed roller are rotated by driving means, the feed roller periodically exerts a frictional force on an outer article of the stack at the location of said roller, so that said article is shifted from the stack to the separation area, where the conveyor roller engages said article and carries in off in the direction of transport, and the pressure force exerted by the feed roller on said outer article is reduced at least while the conveyor roller engages said article.

Such a method is known from DE-A-33 34 522. Reducing the force with which the feed roller presses against the outer article of the stack when the conveyor roller engages that article, offers the advantage than a smaller separation force directed counter to the direction of transport, to be exerted by the separation surface, is required for separating two or more articles which are being fed into the separation area simultaneously by the feed roller.

In addition to being advantageous when a separation roller as proposed in DE-A-33 34 522 is used, reducing the force with which the feed roller presses against the outer article of the stack when the conveyor roller engages that article, is also advantageous when a gap separation system is used in a gap separation system the distance between the separation surface and the conveyor roller is adjusted in correspondence with the thickness of the articles to be separated and the separation surface is kept in a fixed position opposite the conveyor roller. It is true that the frictional force exerted by the article adjacent on the inside acts counter to the direction of transport, rather than in the direction of transport, but in adverse cases separation nevertheless proves problematic. This is caused by the fact that the frictional force which is exerted by the article adjacent on the inside is determined only by the dynamic mutual coefficient of friction of the articles, while the frictional force exerted by the article adjacent on the outside, acting in the direction of transport, is determined by the considerably greater static mutual coefficient of friction between the articles—for instance the outer article and the article in contact therewith—which travel at an equal speed. Without reduction of the pressure force of the feed roller when the conveyor roller is in engagement with an article supplied, it has appeared that when a gap separation system is used the successive delivery of the articles is very sensitive to a proper adjustment of the size of the gap relative to the thickness of the articles to be separated.

The manner of reducing the pressure force of the feed roller, as proposed in DE-A-33 34 522, however, requires a costly construction which comprises an electromagnet partly cancelling the pressure force and means for switching this electromagnet.

In U.S. Pat. No. 4,522,385 a method and an apparatus for transporting top sheets from a stack are described, in which a feed roller drive comprises a lost motion coupling, to avoid that a subsequent sheet is fed toward a separation area, before the previous sheet is transported away from said area. The feed roller exerts a constant pressure force on the stack, which is urged against the feed roller by a spring under the stack.

In DE-A-2 851 548 a method and an apparatus for transporting top sheets from a stack are described, in which the apparatus comprises a separating roller for separating outer sheets from a stack. To separate the sheets, the sheets are held back by edge pressing means and the outer sheet is urged past said edge pressing means. The pressure force exerted by the separation roller is enhanced by the frictional force exerted by the separation roller, to enhance traction between the separation roller and an outer sheet when two sheets are difficult to separate.

In U.S. Pat. No. 2,791,425 a method and an apparatus for transporting top sheets from a stack are described, in which the apparatus comprises a feeding roller for separating outer sheets from a stack. To avoid the risk of slipping of this roller relatively to the sheets and reducing the risk of the two topmost sheets sticking together, the rotational speed of the roller is gradually accelerated when a sheet is to be fed.

The object of the invention is to provide a method of delivering one by one flat articles of some stiffness, such as paper or plastics sheets or envelopes, from a stack in a direction of transport, which method can be carried out reliably with a simple construction.

According to the invention, this object is accomplished in that each time an article is carried off by the conveyor roller, the feed roller is rotated by said article, as long as it is in contact with said article, and the force with which the feed roller is pressed against the stack is enhanced by the action of frictional force which is exerted by the feed roller on said article in the direction of the separation area and reduced when the conveyor roller engages said article.

By virtue of the fact that the action of the frictional force is used for reinforcing the pressure force of the feed roller, it can be pressed against the stack of articles with a smaller initial pressure and no separate driving means are necessary for periodically increasing or reducing the pressure force of the feed roller on the stack. By virtue of the fact that, each time an article is carried off by the conveyor roller, the feed roller is rotated by that article, an interruption of the frictional force exerted by the feed roller in the direction of the conveyor roller and hence an interruption of the reinforcement—and therefore a reduction—of the pressure force of the feed roller on the stack is obtained.

A further advantage of enhancing the pressure force by the action of the frictional force is that the pressure force is increased exclusively when that is necessary for exerting the frictional force contemplated.

The invention is based on the insight that the feed roller is already coupled with means for exerting a frictional force on a stack of articles, which means, by controling that force and coupling that force to the normal forces exerted by the feed roller, can be used for varying the pressure force.

The method according to the invention can be used for taking articles off the top of a stack as well as for taking articles off the bottom of a stack. Furthermore, the method according to the invention can be used for substantially vertical stacks as well as for stacks stacked in other directions, for instance substantially horizontal stacks.

The invention may further be embodied in an apparatus for delivering one by one flat articles of some stiffness, such as paper or plastics sheets or envelopes, from a stack in a direction of transport, comprising a free, a conveyor roller, a separation surface arranged opposite the conveyor roller in such a way that a separation area is formed between the outer surface of the conveyor roller and the separation surface, a feed roller, arranged upstream of the separation area as viewed in the direction of transport and adapted to feed articles along a feed path to the separation area, a feed roller suspension with which the feed roller is suspended from the frame, at lease one pressing means for pressing the feed roller against the stack with a force, conveyor roller driving means and feed roller driving means.

For carrying out the method according to the invention, in the apparatus of the type described hereinabove, which is known from said DE-A-33 34 522, according to the invention the feed roller driving means comprise a coupling which can permit free rotation of the feed roller at lease in the direction of transport, and the suspension of the feed roller to the frame is such that a frictional force exerted by the feed roller on a stack in the direction of transport can enhance the pressure force of the feed roller on the snack.

Hereinafter the invention will be further illustrated and explained, by way of example, on the basis of two embodiments, with reference to the accompanying drawings, in which:

FIG. 2 is an elevation similar to FIG. 1 of a second embodiment of the invention;

FIG. 4 is a sectional view taken on the line IV—IV of FIG. 3;

FIG. 5 is a graph showing an example of a relationship between frictional force and pressure force exerted by a feed roller.

Figure 1:
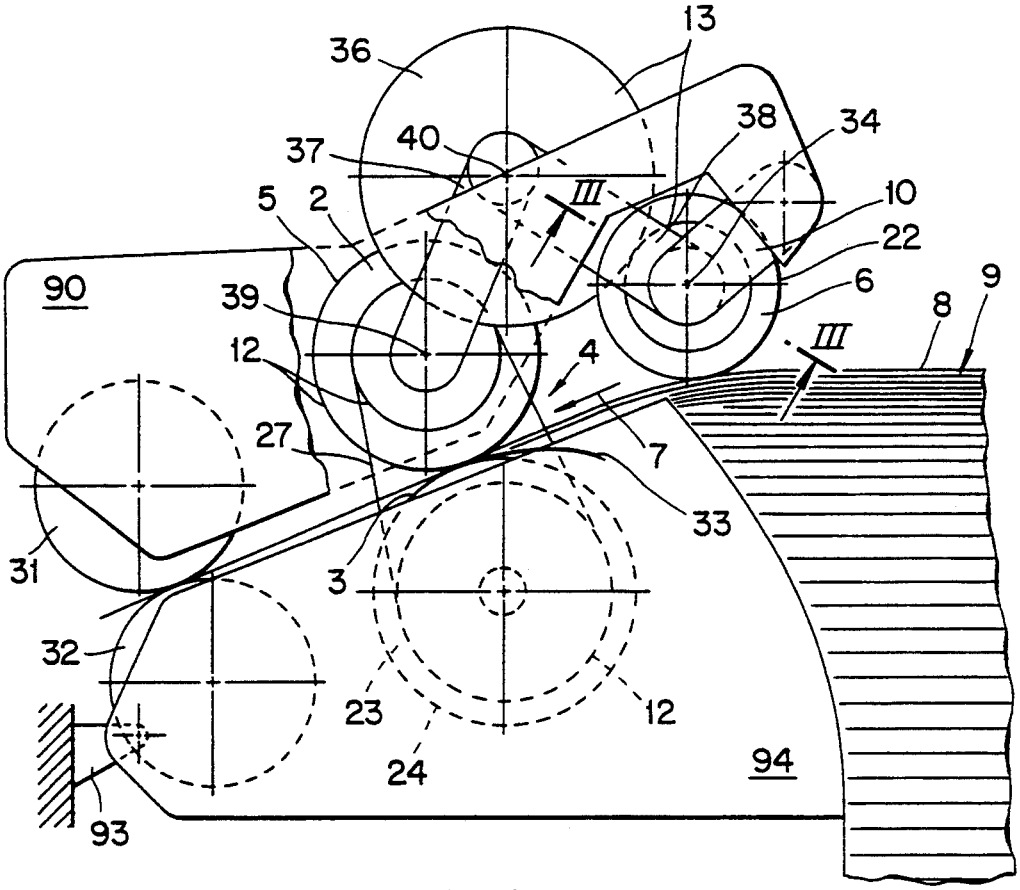
FIG. 1 is a side elevational view of a first embodiment of the invention.

As shown in FIGS. 1 and 2 the embodiments of the apparatus according to the invention each comprise a frame, such parts as are shown being indicated by the reference characters 90–96, a conveyor roller 2, a separation surface 3 provided opposite the conveyor roller 2 in such a way that a separation area 4 is formed between the outer surface 5 of the conveyor roller 2 and the separation surface 3. Arranged upstream of the separation area 4 as viewed in a direction of transport indicated with an arrow 7 is a feed roller 6, adapted for feeding articles 8 along a feed path from a stack 9 to the separation area 4. The feed roller 6 is pivotally suspended relative to the frame part 90 (FIG. 1) and 96 (FIG. 2), respectively, by means of a feed roller suspension 10. Pressing means have been provided for pressing the feed roller 6 against the stack 9 with a force. In the embodiment according to FIG. 1, the pressing means are formed by an intermediate wheel 36, a rocker 38 and the feed roller suspension 10. In the embodiment according to FIG. 2, the pressing means are formed by an intermediate wheel 20 and the corresponding feed roller suspension 10. The conveyor roller 2 and the feed roller 6 are coupled with conveyor roller driving means 12 and feed roller driving means 13, respectively.

Figure 3:
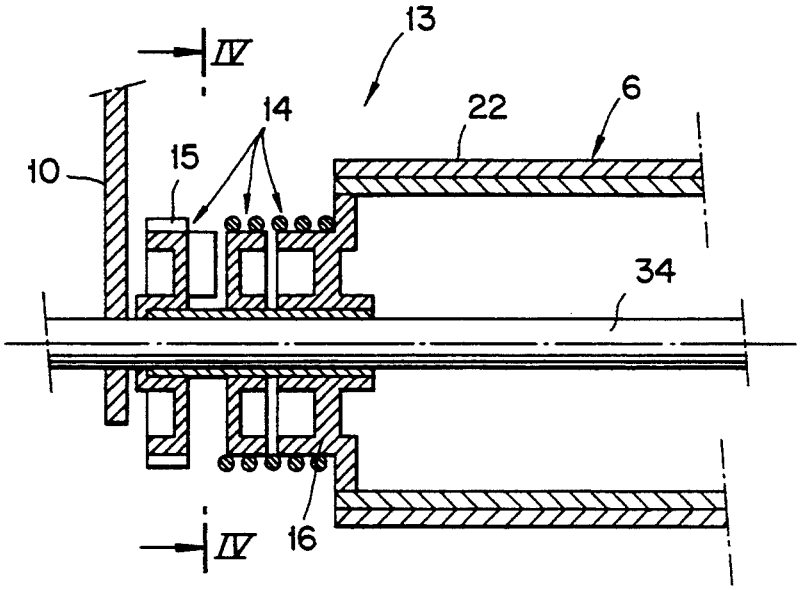
FIG. 3 is a partial view in section taken on the line III—III of FIGS. 1 and 4.

The driving means 12 and 13 are mutually adjusted in such a way that upon driving, a greater circumferential velocity is imparted to the conveyor roller 2 than to the feed roller 6. FIGS. 3 and 4 show a part of the feed roller 6, the feed roller suspension 10 and the feed roller driving means 13 of the embodiment according to FIG. 1. The feed roller driving means 13 comprise coupling means 14 with an input and an output coupling member 15 and 16, respectively, the output coupling member 16 being rotatable relative to the input coupling member 15 counter to the direction of transport indicated by an arrow 17 (FIG. 4) and rotatable in the direction of transport through an angle indicated by the arrow 21. By rotating the output coupling member 16 in the direction of transport relative to the input coupling member 15, a clearance 21 can be built up between said coupling members 15 and 16.

In the embodiment according to FIG. 2 a coupling construction as described hereinabove may for instance be suspended from a shaft 18 of intermediate wheels 19 and 20.

The suspension 10 of the feed roller 6 from the frame part 90, 91 is constructed such than an increase in the frictional force exerted by the feed roller 6 on the stack 9 in the direction of transport (arrow 7) can effect an increase in the pressure force of the feed roller 6 on the stack 9.

During the successive delivery in a direction of transport of flat articles 8 of some stiffness, such as paper or plastics sheets or envelopes, the feed roller 6 presses against an outer article 8 of the stack 9 with a force. The conveyor roller 2 and the feed roller 6 are rotated by means of driving means 12 and 13, respectively. Periodically the feed roller 6 exerts a frictional force on an outer article 8 of the snack 9 at the location of said roller 6, so that said article 8 is shifted from the stack 9 to the separation area 4, where the conveyor roller 2 engages said article 8 and carries it off in the direction of transport (arrow 7). From the moment the conveyor roller 2 engages said article 8, owing to the fact that the respective driving means 12 and 13 impart a greater circumferential velocity to the conveyor roller 2 than to the feed roller 6, due to the displacement of said article 8, the feed roller 6 is driven via the outer surface 22 thereof and the force exerted by said feed roller 6 in the direction of the separation area 4 is interrupted. As a result, the enhancement of the pressure force exerted by the feed roller 6 drops out, so that the pressure force is reduced. The reduced pressure force is maintained as long as the feed roller 6 is in contact with the article 8 being carried off by the conveyor roller 2.

During the carrying off of an article by the conveyor roller 6, in coupling means 14 a rotation of the output coupling member 16 relative to the input coupling member 15 is effected. Each time the contact of the feed roller 6 with an article 8 displaced by the conveyor roller 2 is terminated because said article 8 has moved away from the feed roller 6, an least a part of the driving means 13 of the feed roller 6 rotates through an angle 21 relative to the feed roller 6 until the clearance built up has been traversed. Only then is the drive of the feed roller 6 resumed by these driving means 13 and are the increased pressure force and the frictional force exerted on a next outer article 8 by the feed roller 6. Thus it is accomplished that the feed roller 6 does not immediately push a next article in the direction of the separation area as soon as an outer article has come clear of it. This next article may already have its leading edge disposed in the separation area 4 and might then be pushed through the separation area along with the preceding article which has not left the separation area 4 yet.

According to an alternative embodiment of the invention, in which the driving means 12, 13 are likewise adapted to drive the conveyor roller 2 at a greater circumferential velocity than the circumferential velocity of the feed roller 6, for obtaining a delayed resumption of the drive of the feed roller 6, the feed roller driving means 13 comprise a coupling which can permit completely free rotation of the feed roller 8. Further, in this embodiment a pair of delivery rollers 31, 32 are suspended downstream of the conveyor roller 2 as viewed in the direction of transport. The delivery rollers 31, 32 are connected to driving means (not shown) for driving the delivery rollers 31, 32 at a greater circumferential velocity than the circumferential velocity of the conveyor roller 2. The conveyor roller driving means 12 comprise a coupling which permits free rotation of the conveyor roller 2 in the direction of transport (arrow 7). The feed roller driving means 13 comprise a coupling which enables free rotation of the feed roller 6 when the conveyor roller rotates freely in the direction of transport relative to its driving means.

Owing to the fact that the respective drives impart a greater circumferential velocity to the delivery rollers 31, 32 than to the conveyor roller 2, an article that is being carried off by the delivery rollers 31, 32 carries the conveyor roller 2 along, as long as this article is in contact with the conveyor roller 2. This is rendered possible by the coupling in the conveyor roller driving means 12 which permits free rotation of the conveyor roller 2 in the direction of transport. The coupling which can allow the feed roller 6 to rotate freely when the conveyor roller 2 rotates freely relative to its driving means 12 in the direction of transport accomplishes that the feed roller 6 is non driven until after the conveyor roller 2 being carried along is terminated, i.e. after a preceding article is clear of the conveyor roller 2. Thus the drive 13 of the feed roller 6 remains uncoupled when the conveyor roller 2 is being carried along by an article that is being carried off by the delivery rollers 31, 32.

The coupling which permits free rotation of the conveyor roller 2 in the direction of transport, and the coupling which uncouples the feed roller 6 when the conveyor roller 2 rotates freely in the direction of transport may be integrated into a single coupling. Thus the number of parts can be limited and a simplified assembly can be achieved.

Figure 6:
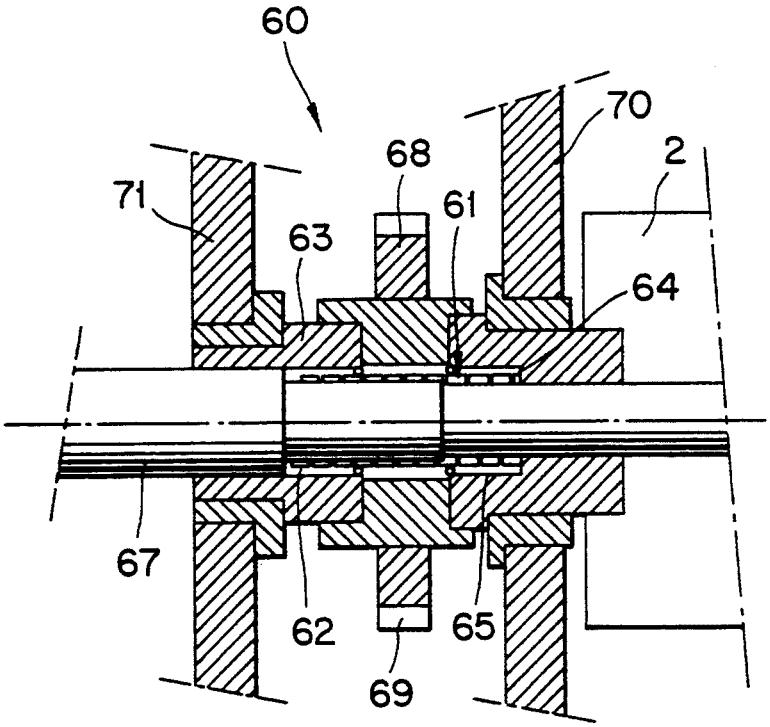
FIG. 6 is a sectional view of a coupling for uncoupling the feed roller from its drive depending on the free rotation of the conveyor roller.

A preferred embodiment of the integrated coupling mentioned above is shown in FIG. 6. The integrated coupling 60 comprises a wrap spring 61 of which one end 62 is connected with an input rotatable member 63. In the present embodiment the input rotatable member 63 is fixedly connected to the shaft 67 which can be driven and is suspended in frame parts 70 and 71. Naturally it is also possible to drive the input member along its outer circumference, for instance by means of a belt or teeth. A portion of the wrap spring 61 adjacent to the other end 64 thereof can engage a first cylindrical inner surface 65 rotatable about its axis and connected to the conveyor roller 2 and a middle portion of the wrap spring 61 can engage a second cylindrical inner surface 66 rotatable about its axis and connected to the feed roller 6. The second cylindrical inner surface 66 has a greater diameter than the first cylindrical inner surface 65, so that the wrap spring 61 in unloaded condition is biassed into contact with the first cylindrical surface 65 and is clear of the second cylindrical surface 66. The second cylindrical inner surface 66 is connected to the drive of the feed roller 6. For this purpose, according to the present embodiment, this is part of a gear wheel 68 with rectilinear teeth 69. Further parts of the drive of the feed roller 6 are not shown in FIG. 6.

When the conveyor roller 2 is carried along by an article, it rotates freely relative to the input rotatable member 63, so that the wrap spring remains unloaded and remains clear of the second cylindrical surface 66. In that condition the feed roller 6 is freely rotatable. As soon as the conveyor roller 2 is no longer carried along by an article that is in contact therewith, the wrap spring 61 is first clamped tightly against the first cylindrical surface 65, which it was already in contact with, and is subsequently loaded by, so that the wrap spring 61 is further clamped against the second cylindrical surface 66, so that the drive of the feed roller 6 is coupled to the drive of the conveyor roller.

It is observed that, naturally, the cylindrical surfaces may also be constructed as outer surfaces when the coupling construction is correspondingly adapted.

According to a further embodiment of the invention a detector 81 is arranged in the separation area 4 or slightly spaced therefrom in the direction of transport (arrow 7), which detector is connected to the coupling which can uncouple the feed roller from its driving means for uncoupling the feed roller from its driving means when the detector observes the presence of an article in the separation area. In that case, it is not necessary that a greater circumferential velocity is imparted to the conveyor roller 2 than to the feed roller 6.

Each time the leading edge of an article is detected by the detector, the drive of the feed roller is uncoupled and remains uncoupled until the trailing edge of that article is detected by the detector. Due to the uncoupling, the frictional force exerted by the feed roller 6 drops out, so that the reinforcement of the pressure force exerted by that feed roller 6 on the stack is cancelled. An advantage of this effect of the invention is that in order to cause the enhancement of the pressure force to drop out it is not necessary that the conveyor roller 2 overcomes the friction of an article relative to an adjacent article, increased by the increased pressure force of the feed roller 6.

It is observed that for a simple detection of the articles carried off by the conveyor roller 2 it is advantageous when the detector is arranged downstream of the separation area viewed in the direction of transport. In that case, the detection is not by any next article that has been carried along with the outer article of the snack into the separation area 4.

Within the framework of the invention various embodiments of the suspension of the feed roller are possible for obtaining an enhancement of the pressure force exerted by the feed roller 6 by virtue of the frictional force exerted by that roller in the direction of the conveyor roller 2.

According to the embodiment shown in FIG. 2, the feed roller 6 is suspended by means of a rocker 35 for pivotal movement relative to the frame part 96 about a pivotal axis 18 parallel to the axis of rotation 34 of the feed roller 6. Relative to the pivotal axis 18, the axis of rotation 34 is spaced closer to the supply path and located downstream in the direction of transport (arrow 7).

The exertion of the frictional force hereby causes a force reaction which comprises a component directed towards the feed path. The pressure force exerted on the outer article 8 is thus increased by the frictional force exerted.

According to the embodiment shown, the feed roller 6 is coupled to an intermediate wheel 20 whose axis of rotation coincides with the pivotal axis 18 of the rocker 35. This offers the advantage that the drive torque which is exerted on the feed roller 6 has a positive influence on the pressure force. This in turn makes it possible for the operational angular range of rocker 35 relative to the feed path to be selected relatively acute, so that the pressure force is relatively insensitive to variations of the position of the rocker 35.

According to the embodiment shown in FIG. 1, the drive coupling between the feed roller 6 and the conveyor roller 2 is formed by an intermediate wheel 36 which is in engagement with the conveyor roller 2 and the feed roller 6 and which by means of rockers 37 and 38 is pivotable about the axis of rotation 39 of the conveyor roller 2 and the axis of rotation 34 of the feed roller 6, these rockers 37 and 38 being moreover connected for pivotal movement relative to each other about the axis of rotation 40 of the intermediate wheel 36. This offers the advantage that no rope or the like is necessary for driving the feed roller 6 and that a compact construction is obtained.

The apparatus according to the embodiment shown in FIG. 1 comprises a separation roller 23 whose outer surface 24 forms the separation surface 3. The outer surface 24 of the separation roller 23 can be rotated such that the separation surface 3 moves counter to the direction of transport. Articles 8 which have come between the outer article 8 and the separation surface 3 are thereby shifted back counter to the direction of transport. By reducing the force with which the feed roller 6 presses against the stack 9, an article 8 that is being shifted back by the separation roller 23 is subject to less resistance than if the feed roller 6 pressed against the stack 9 with the same pressure force as when the articles 8 are being fed towards the separation area 4.

The separation roller 23 is suspended from a part 94 of the frame, which is constructed as a rocker which is pivotable about an axis so that the distance between the separation roller 23 and conveyor roller 2 can be varied in correspondence with the thickness of the articles 8 disposed therebetween. The pressure force of the separation roller 23 in the direction of the conveyor roller 2 can be delivered by a resilient rope 27 which also serves as a driving rope which couples the rotation of the conveyor roller 2 to that of the separation roller 3.

The embodiment shown in FIG. 2 comprises a separation surface 3, which is mounted rigidly in the direction of transport. The position Df the separation surface 3 can be adjusted as to its distance from the conveyor roller 2, for instance by means of a setting wheel 29, supported by a suspension element 28 and a screw thread 30, so that the distance can be adjusted no the thickness of the articles 8 to be separated.

Preferably the outer surface 5 of the conveyor roller 2 has a greater coefficient of friction relative to the articles 8 than the coefficient of friction of the separation surface 3 relative to those articles 8. In this way it is accomplished that when only one article 8 is disposed between the conveyor roller 2 and the separation surface 3, this article will in any case be carried off at a speed equal to the circumferential velocity of the conveyor roller 2, so that the frictional force exerted by the feed roller 6 in the direction of the separation area 4 will be cancelled and the free angular rotation between the feed roller 6 and the feed roller driving means 13 can be built up.

According to the embodiments described, a pair of delivery rollers 31 and 32 are arranged downstream of the separation area viewed in the direction of transport. In cooperation with a sensor (not shown), they can periodically convey each article 8 supplied and be stopped simultaneously with the driving means 12 and 13 depending on the detection of that article 8 by the sensor, so that an article 8 can periodically be held accurately in readiness in a predetermined position. The operation of the apparatus as described hereinbefore can be interrupted and resumed at any time according as desired, for instance for a single article 8 to be periodically delivered in response to a command.

The dependency of the force with which the feed roller 6 bears on an outer article 8, of the frictional force exerted by that feed roller 6 in the direction of the separation area 4 is preferably such that the force with which the feed roller 6 bears on an outer article 8 when the frictional force is being exerted, is increased by at least 0.5 times the frictional force which is exerted in the direction of the separation area 4. Thus a sufficiently low pressure force can be effected during separation and a sufficiently high pressure force during feeding.

A particularly advantageous effect of the dependency of the force with which the feed roller 6 bears on an outer article 8, of the frictional force exerted by the feed roller 6 in the direction of the separation area 4, is obtained when the force with which the feed roller 6 bears on an outer article 8 during exertion of the frictional force is increased by 0.8–0.9 times the frictional force which is exerted in the direction of the separation area 4. Using relationship between pressure force and frictional force, the pressure forces during separation and feeding are further optimized, while at the same time it is ensured that the increase of the pressure force does not effect an increase of the friction of an outer article 8 relative to an adjacent article 8 such that this friction cannot be overcome by the drive 13 of the feed roller 6.

The pressure force with which the feed roller 6 bears on an outer article 8 can be increased during the exertion of the frictional force up to at most a predetermined maximum pressure force. In this manner, too, it can be ensured that the pressure force of the feed roller 6 is not increased such that as a result of the friction of the outer article 8 relative to an article 8 adjacent thereto, the required frictional force is increased such that the drive 13 is loaded too heavily or jams for lack of driving torque.

Accordingly, when determining the increase of the pressure force exerted by the feed roller 6 as a result of the frictional force exerted by that feed roller 6 in the direction of the coveyor roller 2, no account needs to be taken of jamming of the feed roller 6 as a result of a frictional force to be overcome that has run up too much. This in turn offers the advantage that a strong increase of the pressure force as a result of the frictional force exerted can be chosen, so that the feed roller engages the outer article reliably. In the case of smooth articles 8, too, in this way slipping of the feed roller 6 which would prevent the conveyance of the outer article 8 and the build-up of an increased pressure force, is avoided, even when the feed roller 6 has lost its original roughness, for instance as a result of prolonged use or the action of chemicals of printing ink or thermal paper.

A limitation of the maximum pressure force exerted by the feed roller 6 can for instance be obtained by suspending the feed roller suspension 10 from a frame part 96, which is pivotable about the axis of the conveyor roller 2 and which unloaded by its own mass is kept in an extreme position pivoted towards the stack 9, as shown in FIG. 2. The maximum pressure force to be exerted by the feed roller 6 is determined by the mass of the frame part 96 and the parts affixed thereto. The frame part 96 may also be coupled to the frame part 91 by means of resilient elements, whereby an increased maximum pressure force can be obtained.

FIG. 5 shows an example of an advantageous relationship between the frictional force $F_W$ exerted by the feed roller in the direction of the separation area 4 and the pressure force $F_N$ exerted by the feed roller 6.

Preferably, in the separation area 4 guiding members 33 are arranged (see FIG. 1) which are relatively smooth in comparison with the separation surface 3 and which push the articles 8 supplied towards the conveyor roller 2, the guide members 33 being at least partly disposed in recesses in separation surface 3. As a result the articles 8 are pressed with a greater pressure force against the conveyor roller 2 than against the separation surface 3, so that the articles are reliably carried along without slip by the conveyor roller 2. In conjunction with the higher circumferential velocity of the conveyor roller 2 relative to the circumferential velocity of the feed roller 6, this is of particular importance because the frictional force exerted by the conveyor roller 2, when a single article 8 is being passed through, must overcome the frictional force relative to adjacent articles 8 of the stack 9 in addition to the frictional force exerted by the separation surface 3, and must drive the feed roller 6. Once an article 8 travels along with the conveyor roller 2 without slip, the frictional force between the conveyor roller 2 and that article 8 is determined by the mutual static coefficient of friction between them, which is considerably greater than the corresponding dynamic coefficient of friction. Instead of a plurality of guide members 33, it is also possible to utilize a single appropriately formed guide member.

A simple construction of the guide members 33 can be obtained by designing them as shown in the embodiment, as resiliently flexible strips which in unloaded condition intersect the feed path in the direction of transport obliquely in the direction of the conveyor roller 2 and are disposed on the supply side of the separation area 4 and on the side of the separation surface 3 relative to the feed path.

In the construction according to the embodiment shown in FIGS. 3 and 4, the coupling 14, which is part of the drive means 13 of the feed roller 6, comprises a freewheel clutch. As a result, the rotatability of the output coupling member 16 in the direction of transport relative to the input coupling member 15 is unlimited. This offers the advantage that the angular displacement of the clearance to be built up in the coupling 14 when an article 8 is being carried off by the conveyor roller 2, can be selected independently of the length of the paper to be processed.

According to an alternative embodiment of the invention (not shown) an unlimited rotatability in the direction of transport of the output coupling 16 relative to the input coupling member 15 is obtained, for instance by providing the coupling 14 with an element having an internal screw thread and an element having an external screw thread. In that case the number of turns through which the two elements can be rotated relative to each other after the screw threads have mutually engaged, determines the clearance through which the output coupling member can be rotated in the direction of transport relative to the input coupling member. Such a construction is of simple design and requires few parts.

For building up said clearance 21 the coupling means 14 shown in FIGS. 3 and 4 comprise a clearance coupling. The clearance coupling comprises a driving projection and a driven projection. When the feed roller 6 is driven by an outer article 8 (not shown in FIG. 4) in the direction of transport indicated by an arrow 17, the driven projection comes clear off the driving projection and the clearance 21 is built up. Here it is of importance that the clearance coupling generates comparatively little friction relative to the freewheel coupling 16, so that the build-up of the clearance is ensured. According to the present invention, this is accomplished by virtue of the fact that the freewheel clutch 16 is designed as an appropriately coiled wrap spring coupling.

We claim:

1. A method of delivering, one by one, flat articles of some stiffness, such as paper or plastic sheets or envelopes, from a stack in a direction of transport, using a feed roller exerting a pressure force on an outer article of the stack, a conveyor roller opposite which a separation surface is arranged, and in which the conveyor roller and the separation surface form a separation area between an outer surface of the conveyor roller and the separation surface, comprising the steps of:

rotating the conveyor roller and the feed roller by driving means, periodically exerting a frictional force on an outer article of the stack by the feed roller, so that said article is shifted from the stack to the separation area, where the conveyor roller engages said article and carries said article off in the direction of transport, and reducing the pressure force exerted by the feed roller on said outer article at least while the conveyor roller engages said article, wherein each time an article is carried off by the conveyor roller, rotating the feed roller by said article, as long as said feed roller is in contact with said article, and enhancing the force with which the feed roller is pressed against the stack by the action of the frictional force which is exerted by the feed roller on said article in a direction of the separation area and reducing the force when the conveyor roller engages said article.

2. A method according to claim 1, wherein the driving means impart a greater circumferential velocity to the conveyor roller than to the feed roller, each article being passed between a pair of delivery rollers downstream of the conveyor roller, the delivery rollers for delivering an article being driven at a greater circumferential velocity than the circumferential velocity of the conveyor roller, an article being in engagement both with the delivery rollers and with the conveyor roller, said article rotating the conveyor roller, and the feed roller is uncoupled from the driving means when the conveyor roller is rotated by an article which is being carried off by the delivery rollers.

3. A method according to claim 1, wherein a leading edge of an article is detected in an area including the separation area and extending a slight distance downstream thereof and in response to the detection of said leading edge the feed roller is uncoupled from the driving means and remains uncoupled at least until a trailing edge of said article has reached the separation area.

4. A method according to claim 1, wherein the driving means impart a greater circumferential velocity to the conveyor roller than to the feed roller, and each time a contact of the feed roller with an article carried off by the conveyor roller is terminated, an input coupling member of the driving means of the feed roller, at least partly rotates through a limited clearance relative to the feed roller before the feed roller is again driven by the driving means of said feed roller.

5. A method according to claim 1, wherein the pressure force with which the feed roller bears on an outer article when the frictional force is exerted, is increased by at least 0.5 times the frictional force which is exerted in the direction of the separation area.

6. A method according to claim 5, wherein the pressure force with which the feed roller bears on an outer article when the frictional force is exerted, is increased within a range of 0.8–0.9 times the frictional force which is exerted in the direction of the separation area.

7. A method according to claim 1, wherein the pressure force with which the feed roller bears on an outer article when the frictional force is exerted, is increased up to at most a predetermined maximum pressure force.

8. A method according to claim 1, wherein a pressure force between the conveyor roller and each article is greater than a pressure force between the separation surface and the respective article.

9. An apparatus for delivering one by one flat articles of some stiffness, such as paper or plastic sheets or envelopes, from a stack in a direction of transport, comprising a frame, a conveyor roller rotatably suspended by said frame, a separation surface suspended opposite the conveyor roller in such a way that a separation area is formed between an outer surface of the conveyor roller and the separation surface, the conveyor roller and the separation surface defining a path of transport extending through the separation area, a feed roller, suspended from said frame, upstream of the separation area as viewed in the direction of transport and adapted to feed articles along a feed path in the direction of transport to the separation area, a feed roller suspension with which the feed roller is suspended from the frame, at least one pressing means for pressing the feed roller against the stack with a force, conveyor roller driving means operatively connected to the conveyor roller and feed roller driving means operatively connectable to the feed roller, wherein the feed roller driving means comprise a coupling which, at least in the direction of transport, permits at least some free rotation of the feed roller, and the suspension of the feed roller from the frame is designed such that in use a frictional force exerted by the feed roller on the stack in the direction of transport enhances the pressure force of the feed roller on the stack.

10. An apparatus according to claim 9, wherein the conveyor roller driving means and the feed roller driving means are designed for rotating the conveyor roller and the feed roller at different circumferential velocities, such that the circumferential velocity of the conveyor roller is greater than the circumferential velocity of the feed roller, and the feed roller driving means comprise a coupling, a pair of delivery rollers are suspended downstream of the conveyor roller viewed in the direction of transport, said delivery rollers being connected to driving means for rotating said delivery rollers at a greater circumferential velocity than the circumferential velocity of the conveyor roller, the conveyor roller driving means comprise a coupling which permits free rotation of the conveyor roller in the direction of transport, and the coupling of the feed roller driving means enables free rotation of the feed roller when the conveyor roller rotates freely in the direction of transport.

11. An apparatus according to claim 10, wherein the coupling which permits free rotation of the conveyor roller in the direction of transport, and the coupling which can permit free rotation of the feed roller when the conveyor roller rotates freely in the direction of transport are integrated into a single coupling.

12. An apparatus according to claim 11, wherein said integrated coupling comprises a wrap spring, of which one end is connected to an input rotatable member, a portion adjacent the other end of the wrap spring can engage a first cylindrical surface which is rotatable about an axis of the conveyor roller and connected to the conveyor roller, and a middle portion of the wrap spring can engage a second cylindrical surface rotatable about an axis of the feed roller and connected to the feed roller, the wrap spring in unloaded condition bearing under pretension on the first cylindrical surface and being clear of the second cylindrical surface.

13. An apparatus according to claim 9, wherein a detector is arranged in an area including the separation area and extending a slight distance downstream thereof, the coupling of the feed roller driving means can permit free rotation of the feed roller in both directions of rotation, and the detector is connected to the coupling of the feed roller driving means for operating the coupling of the feed roller driving means in such a way that free rotation of the feed roller is permitted when the detector detects the presence of an article.

14. An apparatus according to claim 9, wherein the driving means of the conveyor roller and the feed roller are designed for rotating the conveyor roller at different circumferential velocities such that the circumferential velocity of the conveyor roller is greater than the circumferential velocity of the feed roller, and the feed roller driving means comprise coupling means having an input and an output coupling member, the output coupling member being capable of limited rotation counter to the direction of transport relative to the input coupling member and being capable of rotation in the direction of transport through at least a limited angle, such that as a result of rotation of the output coupling member in the direction of transport relative to the input coupling member a clearance can be built up between said coupling members.

15. An apparatus according to claim 14, wherein the output coupling member of the feed roller driving means is unlimited rotatable in the direction of transport relative to the input coupling member of the feed roller driving means.

16. An apparatus according to claim 14, wherein said coupling means comprise a clearance clutch.

17. An apparatus according to claim 16, wherein said coupling means further comprise a freewheel clutch, the clearance clutch exhibiting comparatively low friction relative to the freewheel clutch.

18. An apparatus according to claim 9, wherein the feed roller is mounted for pivoting movement relative to the frame about a pivot axis parallel to an axis of rotation of the feed roller, the axis of rotation being disposed at a smaller distance from the feed path relative to the pivot axis and downstream thereof in the direction of transport.

19. An apparatus according to claim 9, wherein the feed roller is coupled to an intermediate wheel, whose axis of rotation coincides with the pivot axis of the feed roller.

20. An apparatus according to claim 9, comprising an intermediate wheel, which is in engagement with the conveyor roller and the feed roller and which is suspended by means of rockers for pivotal movement about an axis of rotation of the conveyor roller and an axis of rotation of the feed roller, the rockers being connected for mutual pivotal movement about an axis of rotation of the intermediate wheel.

21. An apparatus according to claim 9, wherein the conveyor roller has an outer surface with said outer surface and the separating surface having different coefficients of friction relative to the articles, the coefficient of friction of said outer surface being greater than the coefficient of friction of the separation surface.

22. An apparatus according to claim 9, wherein there is arranged in the separation area at least one guide member which in comparison with the separation surface is relatively smooth and which forces the articles supplied towards the conveyor roller, the guide member being disposed at least partly in oppositely arranged recesses in the separation surface and the outer surface of the conveyor roller.

23. An apparatus according to claim 22, wherein said at least one guide member is designed as a resiliently flexible strip which in unloaded condition intersects the feed path in the direction of transport obliquely in a direction of the conveyor roller and whose portion upstream of the separation area is located on a same side of the feed path as the separation surface.

* * * * *